US011753224B2

(12) United States Patent
Hayter et al.

(10) Patent No.: US 11,753,224 B2
(45) Date of Patent: Sep. 12, 2023

(54) ARTICLE CARRIER AND BLANK THEREFOR

(71) Applicant: WestRock Packaging Systems, LLC, Atlanta, GA (US)

(72) Inventors: Gregory P. Hayter, Atlanta, GA (US); Carl J. Gibson, Opelika, AL (US); James J. Talbot, Lafayette, AL (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 441 days.

(21) Appl. No.: 16/107,375

(22) Filed: Aug. 21, 2018

(65) Prior Publication Data

US 2019/0055071 A1 Feb. 21, 2019

Related U.S. Application Data

(60) Provisional application No. 62/547,921, filed on Aug. 21, 2017.

(51) Int. Cl.
*B65D 71/58* (2006.01)

(52) U.S. Cl.
CPC ..... *B65D 71/0022* (2013.01); *B65D 2301/10* (2013.01); *B65D 2571/0066* (2013.01); *B65D 2571/00141* (2013.01); *B65D 2571/00388* (2013.01); *B65D 2571/00487* (2013.01); *B65D 2571/00524* (2013.01); *B65D 2571/00802* (2013.01); *B65D 2571/00956* (2013.01)

(58) Field of Classification Search
CPC ..... B65D 71/0022; B65D 2571/00141; B65D 2571/00388; B65D 2571/00487; B65D 2571/0066; B65D 2571/00956
See application file for complete search history.

(56) References Cited

U.S. PATENT DOCUMENTS

| | | | | |
|---|---|---|---|---|
| 3,794,210 | A * | 2/1974 | Stout | B65D 71/0022 206/173 |
| 3,917,059 | A | 11/1975 | Wood | |
| 4,000,813 | A | 1/1977 | Stout | |
| 4,117,925 | A | 10/1978 | Wood | |
| 4,480,746 | A * | 11/1984 | Wood | B65D 71/0022 206/161 |
| 2016/0318649 | A1* | 11/2016 | Bundy | B65D 21/0233 |

* cited by examiner

*Primary Examiner* — Anthony D Stashick
*Assistant Examiner* — L Kmet
(74) *Attorney, Agent, or Firm* — Brian J. Goldberg

(57) ABSTRACT

Aspects of the disclosure relate to a nestable blank for forming a basket-style carrier. The blank comprises a plurality of panels for forming walls of the carrier, which panels include a first side panel, a second side panel and a bottom panel. The first side panel is hinged to the bottom panel and the bottom panel is asymmetrical. The bottom panel has first and second opposed end edges, and the first end edge is offset from a first end edge of the adjacent first side panel by a first distance. The second end edge of the bottom panel is offset from a second end edge of the adjacent first side panel by a second distance, and the first distance is greater than the second distance. The bottom panel also comprises a beveled corner.

17 Claims, 8 Drawing Sheets

ARTICLE CARRIER AND BLANK THEREFOR

TECHNICAL FIELD

The present invention relates to a blank for forming a carrier and to the carrier itself. More specifically, but not exclusively, the invention relates to a blank for forming carrier of the basket-style wherein a medial partition divides the carrier into at least two cells, and wherein a carrying handle is provided which facilitates the transport of the carrier.

BACKGROUND

In the field of packaging it is known to provide basket-style article carriers for carrying multiple articles. Basket-style article carriers are well known in the art and are useful for enabling consumers to transport, store and access a group of articles for consumption. These carriers typically have a handle on top, such that the carrier mimics a conventional basket, and typically include a riser or medial partition from which the handle is fashioned. For cost and environmental considerations, such cartons or carriers need to be formed from as little material as possible and cause as little wastage in the materials from which they are formed as possible. Typically blanks for forming such carriers are arranged on a blank grid—the more blanks that can be fitted onto the grid, the less material that is wasted. In certain applications, a too close arrangement of too tight nesting of blanks in a blank grid can be disadvantageous. This is because the closer fitting of the blanks makes it difficult to separate and remove the cut blanks, without tearing of the blanks, from a larger sheet of material from which a plurality of individual blanks are cut. Accordingly, there is a balance between the total number of blanks in a blank grid that are cut simultaneously from a single sheet, and the time taken in carefully removing those blanks without tearing.

The present invention seeks to provide an improvement in the field of basket-style article carriers, typically formed from paperboard or the like.

SUMMARY

According to a first aspect of the present invention there is provided a blank for forming a basket-style carrier. The blank comprises a plurality of panels for forming walls of the carrier including a first side panel, a second side panel and a bottom panel. The first side panel is hinged to the bottom panel and the bottom panel is asymmetrical and has first and second opposed end edges. The first end edge is offset from a first end edge of the adjacent first side panel by a first distance. The second end edge of the bottom panel is offset from a second end edge of the adjacent first side panel by a second distance (D5). The first distance is greater than the second distance. The bottom panel may also comprise a beveled corner, which beveled corner is located at an intersection of the first end edge of the bottom panel with a free side edge of the bottom panel, which free side edge is opposite from a side edge of the bottom panel that is hinged to the first side panel.

The first end edge of the bottom panel is off-set, in other words, laterally spaced from a notional line passing through the first end edge of the first side panel. Similarly, the second end edge of the bottom panel is off-set by being laterally spaced from a notional line passing through the second end edge of the first side panel. By reducing the overall size of the bottom panel and by skewing its position to the side and making it "off-center", when adjacent blanks are nested, a greater space (cut-out region) is provided between adjacent blanks in the grid, thus enabling them to be more easily separated from one another and from the sheet of material from which they are struck, even when the number of blanks in the blank grid results in tight and close positioning of blanks. The non-rectangular, i.e. beveled corner further increases the separation between blanks and permits easier release of adjacent blanks from the blank grid. By beveling or otherwise shaping an edge of the bottom panel a cut-out section between adjacent nested blanks in the blank grid may be shaped to lead into a cut line and promote easy removal of blanks along cut-lines and mitigate against unintentional tearing of corner portions (or other parts) of blanks, which it is known, can otherwise occur. Of particular benefit is the provision of a beveled corner, optionally angled in the region of 45° which creates a vertex where converging cut lines (for example the free edge of the bottom panel and the first end edge of the bottom panel) promote complete removal of blanks from the blank grid without tearing.

Optionally, the bottom panel is asymmetrical about a central axis of the first side panel.

Optionally, the first side panel has a width defined as the distance between first and second end edges thereof, and wherein the bottom panel has a width defined as the distance between first and second opposed end edges thereof, the width of the bottom panel may be less than the width of the first side panel, and a notional half-way line of the bottom panel may be off-set from a notional half-way line of the first side panel.

Optionally, a center line of the blank is defined by a notional line through the center of blank 10, positioned half-way along the length of the blank.

A corner distance may be defined as the distance between a notional line coincident with the first end edge of the bottom panel and a notional line coincident with a termination of the beveled corner along said free side edge. A first center distance may be defined as the distance between the first side edge of the bottom panel and the center line. The corner distance may be greater than or equal to the first center distance and the corner distance may be less than or equal to three times the first center distance.

Optionally, said first distance may be greater than the first center distance and the first may be less than two times the first center distance.

Optionally, a corner depth of the beveled corner is defined by the formula: D3=D4×tan(180−θ), wherein 'θ' is an angle defined by the free side edge and the beveled corner (59). Optionally, said angle 'θ' is greater than or equal about 100° and is less than 145°.

Optionally, the second side panel is spaced from and located opposite to the first side panel, and wherein a securing panel is hinged to the second side panel, the securing panel is for attachment to the bottom panel, and the securing panel is asymmetrical about a central axis of the adjacent second side panel and has first and second opposed end edges. Optionally, the first end edge of the securing panel is offset from a first end edge of the adjacent second side panel by a third distance. The second end edge of the securing panel may be offset from a second end edge of the adjacent second side panel by a fourth distance, and the third distance is greater than the fourth distance.

Optionally, the third distance may be a similar distance to the first distance at which first end edge of the bottom panel is offset from the first end edge of the first side panel.

Optionally, the blank is removed from a blank grid.

Optionally, the blank is cut from a larger sheet of material along with a plurality of other similar such blanks and wherein said other similar such blanks and said blank are closely nested on said larger sheet of material.

Optionally, a cut-out region between bottom panels of adjacent nested blanks is generally "Z"-shaped or at least comprises an angled portion. It is envisaged that the bevelled corner of a bottom panel may be provided by at least one angled straight line and in some alternative embodiments by more than one angled and contiguous cut lines. Additionally, or alternatively, the bevelled corner in some arrangements may be provided by a curvilinear cut line or an arcuate cut line that leads into the corner of the cut-out region to allow the blank to be peeled off the blank grid optionally starting in that corner.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
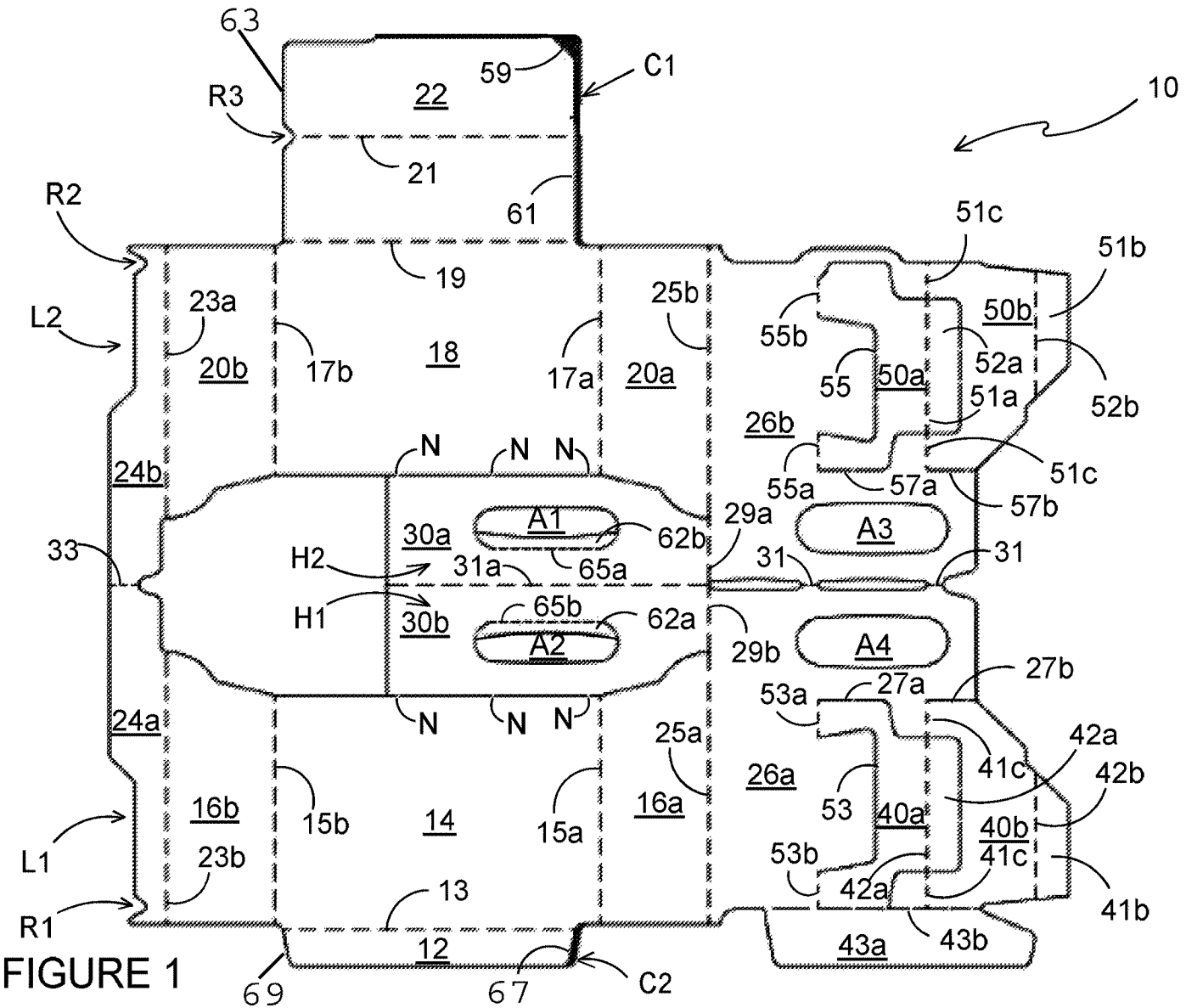
FIG. 1 is a plan view from above of a blank for forming a carrier according to a first embodiment.

Referring to FIG. 1, there is shown a plan view of a blank 10 capable of forming a carton or carrier 90, (see FIG. 4), for containing and carrying a group of primary products, such as, but not limited to, bottles or cans, hereinafter referred to as articles (not shown).

In the embodiments detailed herein, the terms "carton" and "carrier" refer, for the non-limiting purpose of illustrating the various features of the invention, to a container for engaging and carrying articles, such as product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

In the illustrated embodiment, the blank 10 is configured to form a carton or carrier 90 for packaging an exemplary arrangement of exemplary articles. In the illustrated embodiment, the arrangement is a 2×3 matrix or array and the articles are bottles. Alternatively, the blank 10 can be configured to form a carrier for packaging other types, number and size of articles and/or for packaging articles in a different arrangement or configuration. More specifically, the blank may be configured for forming a carrier for holding a 2×2 arrangement of articles and in such an application, eight such (2×2) blanks may be nested or tessellated on and struck from a single large sheet of material (whereas only 6 of the (2×3) blanks may be nested or tessellated on and struck from a single large sheet of material.

Referring to FIG. 1, the blank 10 comprises a plurality of main panels 16*b*, 14, 16*a*, 20*a*, 18, 20*b*, 22 for forming outer walls of a basket-style carrier 90 (see FIG. 9). The plurality of main panels 16*b*, 14, 16*a*, 20*a*, 18, 20*b*, 22 includes a second side panel 14 and a first side panel 18. The second side panel 14 is hinged at a first end to a first end panel 16*a* by a hinged connection such as a fold line 15*a*. The second side panel 14 is hinged at a second end to a second end panel 16*b* by a hinged connection such as a fold line 15*b*. The first side panel 18 is hinged at a first end to a third end panel 20*a* by a hinged connection such as a fold line 17*a*. The first side panel 18 is hinged at a second end to a fourth end panel 20*b* by a hinged connection such as a fold line 17*b*.

The blank 10 comprises a bottom panel 22, optionally hinged to the first side panel 18 by a hinged connection such as a fold line 19. A securing panel 12 is hinged to the second side panel 14 by a hinged connection such as a fold line 13.

The first end panel 16*a* and the third end panel 20*a* together form a first end wall 16*a*/20*a* of the carrier 90. The second end panel 16*b* and the fourth end panel 20*b* together form a second end wall 16*b*/20*b* of the carrier 90.

The blank 10 comprises a first riser panel 24*a* hinged to the second end panel 16*b* by a hinged connection such as a fold line 23*b*. The blank 10 comprises a second riser panel 24*b* hinged to the fourth end panel 20*b* by a hinged connection such as a fold line 23*a*. The first riser panel 24*a* is hinged to the second riser panel 24*b* by a hinged connection such as a fold line 33. Together the first and second riser panels 24*b*, 24*b* assist in coupling the second end panel 16*b* to the fourth end panel 20*b* to form the first composite end wall 16*b*/20*b* when the blank 10 is assembled. The first riser panel 24*a* comprises a first recess R1 which is configured to form a hook-like projection on a side edge thereof. The second riser panel 24*b* comprises a second recess R2 which is configured to form a hook-like projection on a side edge thereof.

The bottom panel 22 comprises an entirely optional hinged connection such as a fold line 21 which extends longitudinally thereacross so as to longitudinally divide the bottom panel 22. The bottom panel 22 comprises a further recess R3 struck from a first end edge thereof; the fold line 21 extends from the further recess R3. The further recess R3 is configured to form a notch for interlocking with the hook-like projections formed in the first riser panel 24*a* and the second riser panel 24*b*.

The second and first side panels 14, 18 are spaced apart; the first end panel 16*a* and the second end panel 20*a* are spaced apart (in blank form); and between them, there is provided first and second handle panels 30*a*, 30*b* which form part of a carrying handle structure. A fold line 31*a* between the first and second handle panels 30*a*, 30*b* hingedly couples those panels 30*a*, 30*b* together. The first handle panel 30*b* is hinged to a first partition panel 26*a* along a hinged connection such as a fold line 29*b*. The second handle panel 30*a* is hinged to a second partition panel 26*b* along a hinged connection such as a fold line 29*a*. Optionally in some arrangements one or both of the first and second handle panels 30*a*, 30*b* may be omitted.

The first partition panel 26*a* is hinged to the first end panel 16*a* along a hinged connection such as a fold line 25*a*.

The second partition panel 26*b* is hinged to the first partition panel 26*a* along a hinged connection such as interrupted fold line 31. The second partition panel 26*b* is hinged to the third end panel 20*a* along a hinged connection such as a fold line 25*a*. A second securing panel 43*a* is hinged by fold line 43*b* to a bottom edge of the first partition panel 26*a*.

The first and second riser panels 24*a*, 24*b* and the first and second partition panels 26*a*, 26*b* each form a partial medial panel of the carrier 90.

The blank 10 further comprises a plurality of partition structures. The partition structures are provided to divide the interior of the basket carrier 90 into separate cells. The cells may or may not be of uniform size and, optionally in the present arrangement, the partition structures divide the interior of the basket carrier 90 into six cells arranged in two rows of three cells each.

The first partition structure comprises a first divider panel 40*a* that is struck from material that would otherwise form part of the first partition panel 26*a* and is hinged thereto by a hinged connection such as a fold lines 53*a*, 53*b*. The first partition structure comprises a first securing tab 42*a* that is hinged to the first partition panel 26*a* by a hinged connection such as a fold line 41*c*. A second divider panel 40*b* is hinged to the first partition panel 26*a* by a hinged connection such as a fold line 41*c*. The first securing tab 42*a* is provided to secure a first end of the first divider panel 40*a*, to the second side panel 14. A second securing tab 41*b* is provided to secure a first end of the second divider panel 40*b*, to the second side panel 14. The second securing tab 41*b* is hinged to the second divider panel 40*b* by means of a fold line 42*b*.

The second partition structure comprises a third divider panel 50*a* that is struck from material that would otherwise form part of the second partition panel 26*b* and is hinged thereto by a hinged connection such as a fold lines 55*a*, 55*b*. The second partition structure comprises a third securing tab 52*a* that is hinged to the second partition panel 26*b* by a hinged connection such as a fold line 51*c*. A fourth divider panel 50*b* is hinged to the second partition panel 26*b* by a hinged connection such as a fold line 51*c*. The third securing tab 52*a* is provided to secure a first end of the third divider panel 50*a*, to the first side panel 18. A fourth securing tab 51*b* is provided to secure a first end of the fourth divider panel 50*b*, to the first side panel 18. The fourth securing tab 51*b* is hinged to the fourth divider panel 50*b* by means of a fold line 52*b*.

The first and second partition panels 26*a*, 26*b* each form a longitudinal partition within the carrier 90. The first, second, third and fourth divider panels 40*a*, 40*b*, 50*a*, 50*b* each form a transverse partition within the carrier 90.

The first and second handle panels 30*a*, 30*b* comprises a first handle structure H1 and a second handle structure H2 respectively. The first handle structure H1 comprises a first handle opening defined in the first handle panel 30*b*. The first handle opening is defined in part by a cut line. Optionally, the first handle opening is defined in part by a first handle aperture A2 struck from the first handle panel 30. Optionally, the first handle opening is defined at least in part by a first cushioning flap 62*a* struck from the first handle panel 30*a* and hingedly connected thereto by a fold line 65*b*.

A portion of the first partition panel 26*a* forms a third handle panel. The portion of the first partition panel 26*a* which forms the third handle panel comprises a third handle structure A4 defined therein. The third handle structure A4 comprises a third handle opening A4. The third handle opening is defined in part by a cut line. Optionally, the third handle opening is defined by a third handle aperture A4 struck from first partition panel 26*a*.

Optionally, a portion of the second partition panel 26*b* forms a fourth handle panel. The portion of the second partition panel 26*b* which forms the fourth handle panel comprises a fourth handle structure A3 defined therein. The fourth handle structure A3 comprises a fourth handle opening A3. The fourth handle opening is defined in part by a cut line. Optionally, the fourth handle opening is defined by a fourth handle aperture A3 struck from second partition panel 26*b*.

The first and second partition panels 26*a* 26*b* are hinged together along a common top edge by interrupted fold line 31. The fold line 31 may be oriented to extend in a longitudinal direction in a set up carrier 90. The fold line 31 may be substantially parallel to the bottom panel 22 in a setup carrier 90. The fold line 31 may substantially perpendicular to the fold line 29*a* which hinges the second handle panel 30*a* to the second partition panel 25.

The blank 10 is arranged so as to comprise a first row or linear series L1 of panels 24*a*, 16*b*, 14, 16*a*, 26*a*/28 and a second row or linear series L2 of panels 24*b*, 20*b*, 18, 20*a*, 26*b*. The first row L1 of panels is hinged to the second row L2 of panels by the fold line 33 between the first and second riser panels 24*a*, 24*b*; by the fold line 31*a* between the first and second handle panels 30*a*, 30*b*; and by the interrupted fold line 31 between the first and second partition panels 26*a*, 26*b*. The outer perimeter of the first and second linear series of panels L1, L2 defines a general footprint of the blank 10. Depending from the second side panel 14, and thus from the first linear series panels L1 is the securing panel 12. Similarly, on the opposite side of the blank 10, the bottom panel 22 extends from the first side panel 18 beyond the second linear series L2.

Figure 7:
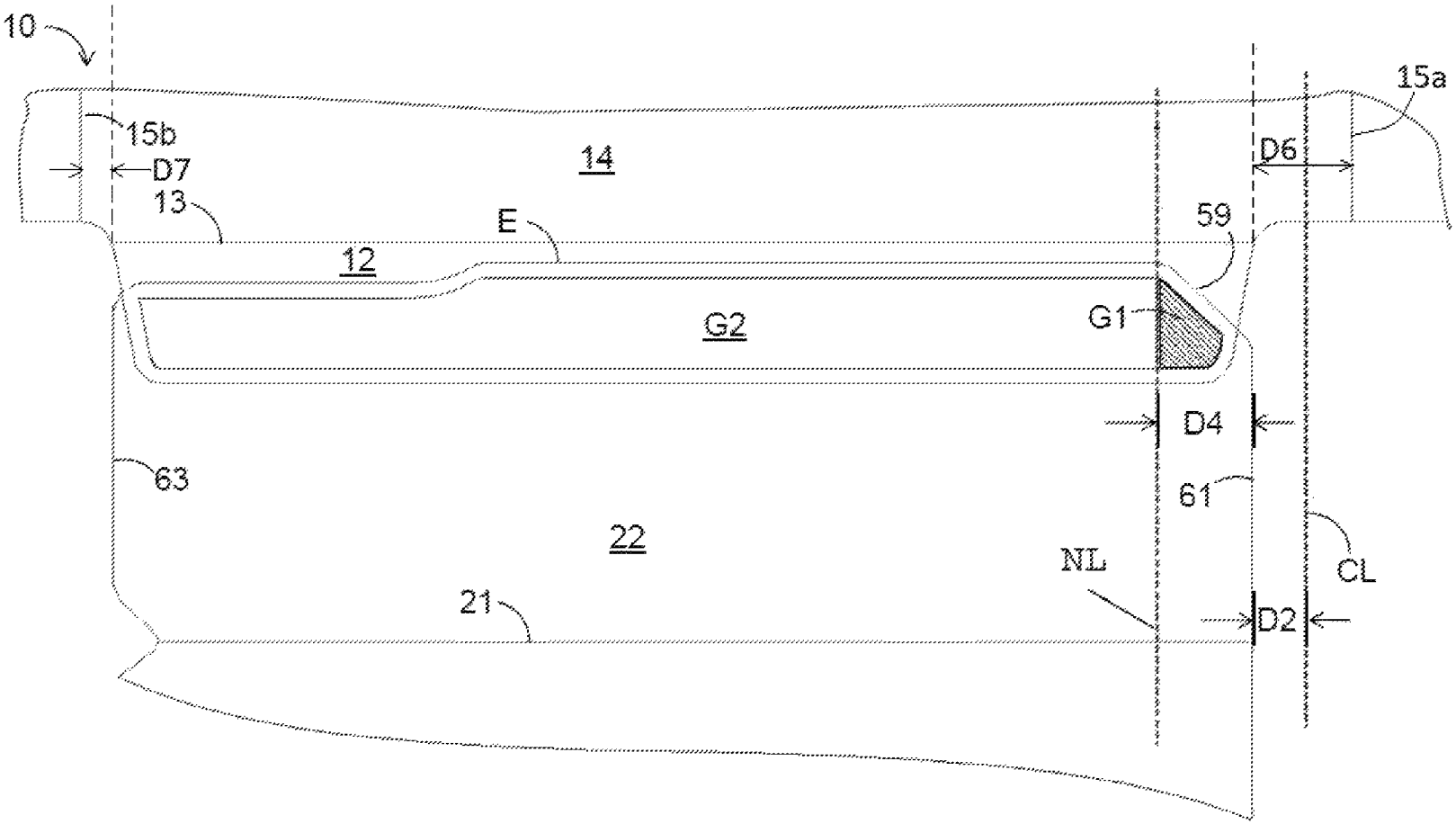
FIG. 7 is an enlarged plan view showing a bottom panel of the blank of FIG. 1 overlaid with a securing panel of the blank of FIG. 1 to illustrate a securely adhered corner portion.

In the present arrangement, it can be seen that the securing panel 12 is not fully co-extensive with the second side panel 14. Whereas a left-hand edge 69 of the securing panel 12 is laterally spaced from the fold lines 15*b* at a fourth distance D7 (FIG. 7), the right-hand edge 67 of the securing panel 12 is laterally spaced further from the fold lines 15*a* at a third distance D6 (FIG. 7). The third distance D6 is greater than the fourth distance D7. Stated differently, the securing panel 12 is asymmetrical about a center axis of the adjacent second side panel 14. To illustrate this, a cut out region C2 is shown in bold outline. The cut out region C2 is not part of the blank 10 and is a cut and removed portion.

Similarly, the bottom panel 22 is not fully co-extensive with the first side panel 18. Whereas a left-hand end edge 63 of the bottom panel 22 is laterally spaced from a notional line aligned with fold line 17*b* by a small distance (second distance D5; see FIG. 8), the right-hand end edge 61 of the bottom panel 22 is laterally spaced from a notional line aligned with the fold line 17*a* by a greater distance (first distance D1; see FIG. 8). The first distance D1 is greater than the second distance D5. Stated differently, the bottom panel 22 is asymmetrical about a center axis of the adjacent first side panel 18. To illustrate this, a second cut out region C1 is shown in bold outline. The cut out region C1 is not part of the blank 10 and is a cut and removed portion. It is removal of this cut out region C1 that gives the bottom panel 22 an asymmetric shape. The bottom panel 22 being asymmetric refers to it being asymmetrical about a center axis of the adjacent first side panel 18. This also results in the spacing between the bottom wall 22 of the assembled carrier 90 and the end wall 16*a*/20*a* being larger than the spacing between the bottom wall 22 of the assembled carrier 90 and the end wall 16*b*/20*b* (see FIG. 5). The asymmetry of the bottom panel 22 whilst not aesthetically unpleasing is unusual; furthermore, the removal of additional material (cut out regions C1 and C2) increases wastage, which is unusual. However, very beneficially, the blank 10 described and illustrated herein provides for a reduction in overall wastage of blanks 10 which are formed (by "cutting", "blanking" or "striking") from a larger sheet of material '5'. See FIG. 3 wherein an arrangement of blanks is nested on a sheet '5'.

Figure 2:
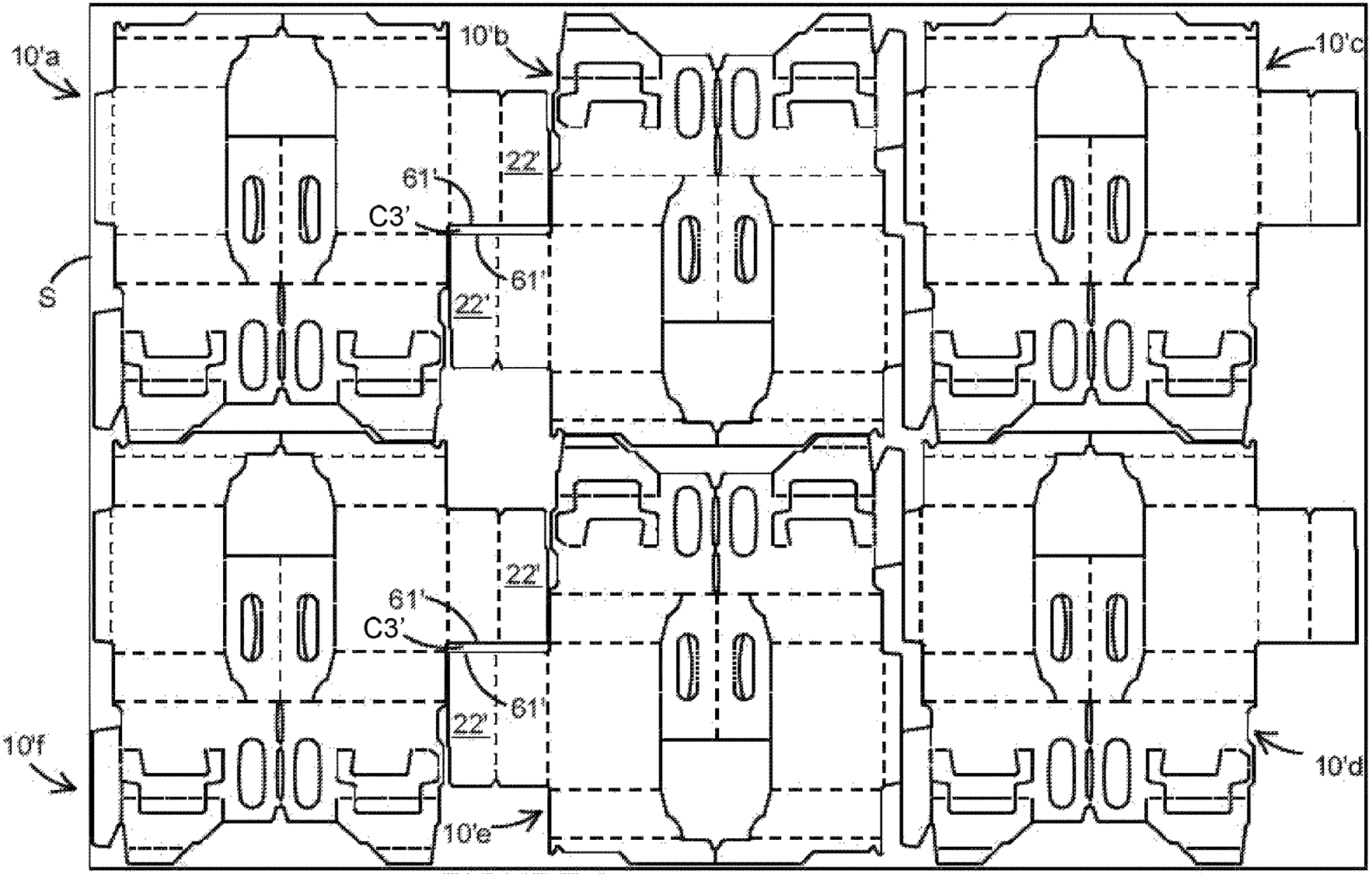
FIG. 2 is a plan view of a standard sized sheet of material from which a nested group of blanks according to the prior art are arranged for being struck therefrom.
Figure 3:
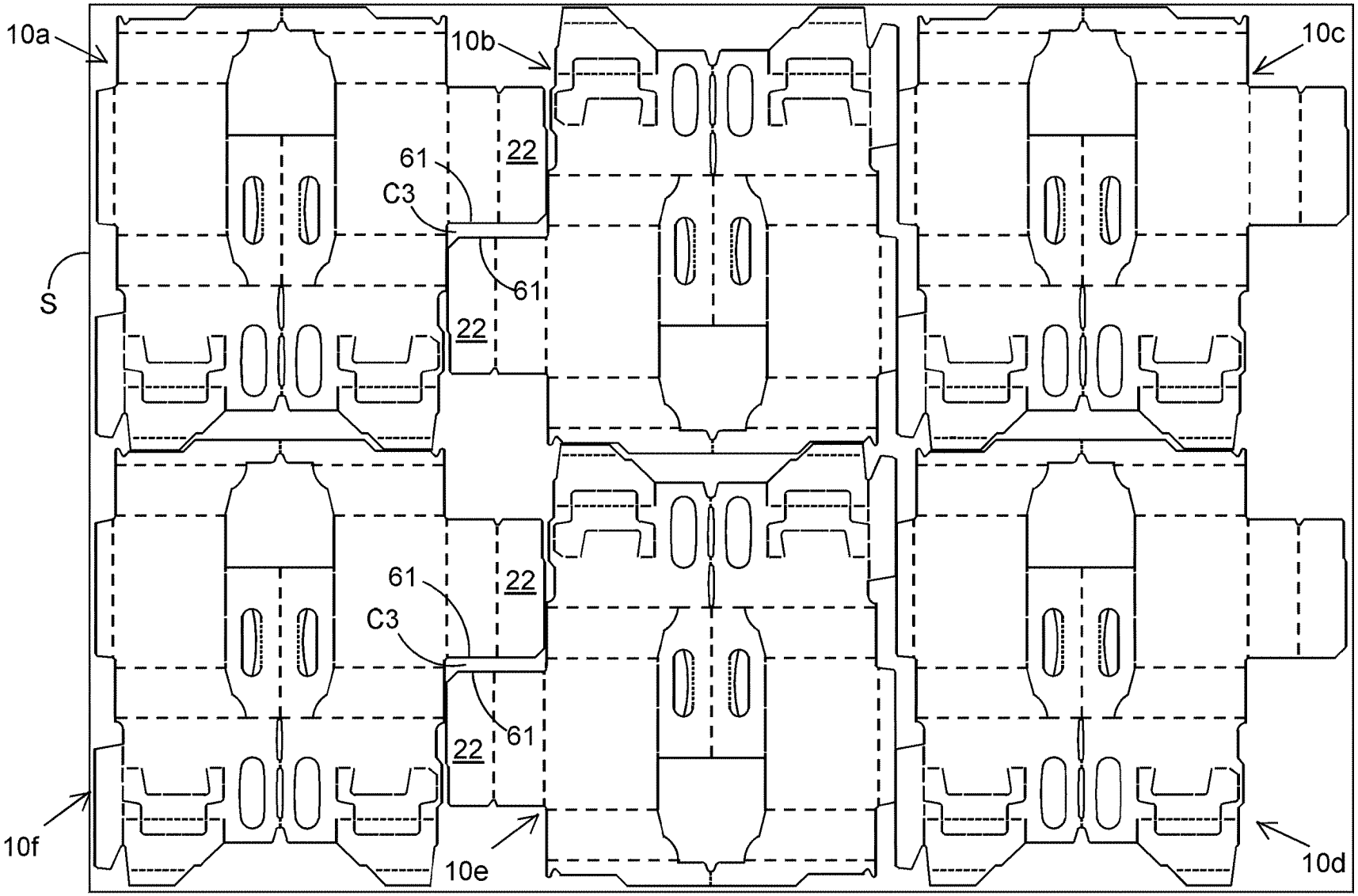
FIG. 3 is a plan view of a standard sized sheet of material from which a nested group of blanks according to FIG. 1 are arranged for being struck therefrom.

As can be seen in FIG. 3, the arrangement of six blanks 10*a*, 10*b*, 10*c*, 10*d*, 10*e*, 10*f* is a close-fitting arrangement in order to maximize the number of blanks 10 that can be cut from such a single sheet '5'. In the layout shown, a bottom panel 22 of a first blank 10*a* is positioned back-to-back with a bottom panel 22 of a second blank 10*b*, such that "right-hand" or "first-edges" 61 are facing each other. A cut-out region 'C3' is disposed between the adjacent blanks 10*a*, 10*b*. It is because of the additional cut-out region 'C1' provided on each blank 10*a*, 10*b*, in other words, because of the asymmetrically arranged and re-sized bottom panel 22 with beveled corner, that a "Z"-shaped cut-out region 'C3' is formed. By offsetting the bottom panel 22 of nested blanks 10*a*, 10*b*, and cutting a bevel on the corner, a gap (Canyon) is created that gives the blanking grid room to break the carton blanks 10*a*, 10*b*, 10*c*, 10*d*, 10*e*, 10*f* apart without ripping or tearing the corners of the bottom panels 22 of the blanks. In this way the cut out region or cut out area C3 between nested blanks 10*a*, 10*b* etc. is increased and this improves cutting speeds, the number of sheets per hour that can be cut and processed is increased, and the quality risks associated with prior art blanking grids are reduced. The increased and specifically shaped cut out region C3 between basket bottom panels 22, with an angle on a corner allows for the blanking grid to turn 90 degrees without it being torn. Further beneficially, the invention allows a cutting team to die-cut faster, with a reduced set-up time, thus reducing labor costs. In prior art blanking arrangements (as shown in FIG. 2) significant labor of a die-cutting team and dozens of hours may be required to produce new tooling to make sure that it would not rip or tear the carton blanks during blanking. The present invention now allows for reduced set-up time, for faster die-cutting speeds to be used and for longer period and with a reduced risk of poor-quality.

For reference, FIG. 2 illustrates a sheet of material S' from which six known blanks 10*a*', 10*b*', 10*c*', 10*d*', 10*e*', 10*f*' are formed. In order to maximize the number of blanks 10*a*', 10*b*', 10*c*', 10*d*', 10*e*', 10*f*' that can be struck from a standard sized sheet of material 'S", it is typical to nest blanks 10' as shown, with a bottom panel 22' of a first blank 10*b*' being disposed immediately adjacent to a bottom panel 22' of a second blank 10*a*'. As shown, the bottom panel 22 is substantially fully co-extensive with the first side panel 18'. The bottom panel 22' is symmetrically positioned relative to the first side panel 18'. In other words, a notional center line of the first side panel 18' is in line with a notional center line of the bottom panel 22'. The sheet of material 'S' shown in FIG. 2 is a standard sized sheet, and six blanks 10*a*', 10*b*', 10*c*', 10*d*', 10*e*', 10*f*', each for forming a basket style carrier that can contain a 2×3 arrangement are arranged thereon. However, the blanking grid can sometimes cause tearing of the blanks when the individual blanks are removed, and as described above this leads to a reduction in quality, slower production time and increased cost. The area of the cut out region C3' between nested blanks 10*a*', 10*b*', 10*c*', 10*d*', 10*e*', 10*f* is smaller than the new area of the cut out region C3 between nested blanks 10*a*, 10*b* etc.

By forming the blanks 10 as show in FIG. 1 and arranging them as shown in FIG. 3, the basket carriers 90 produced therefrom are lower in cost, produced more quickly and suffer far less from low-quality issues.

Figure 4:
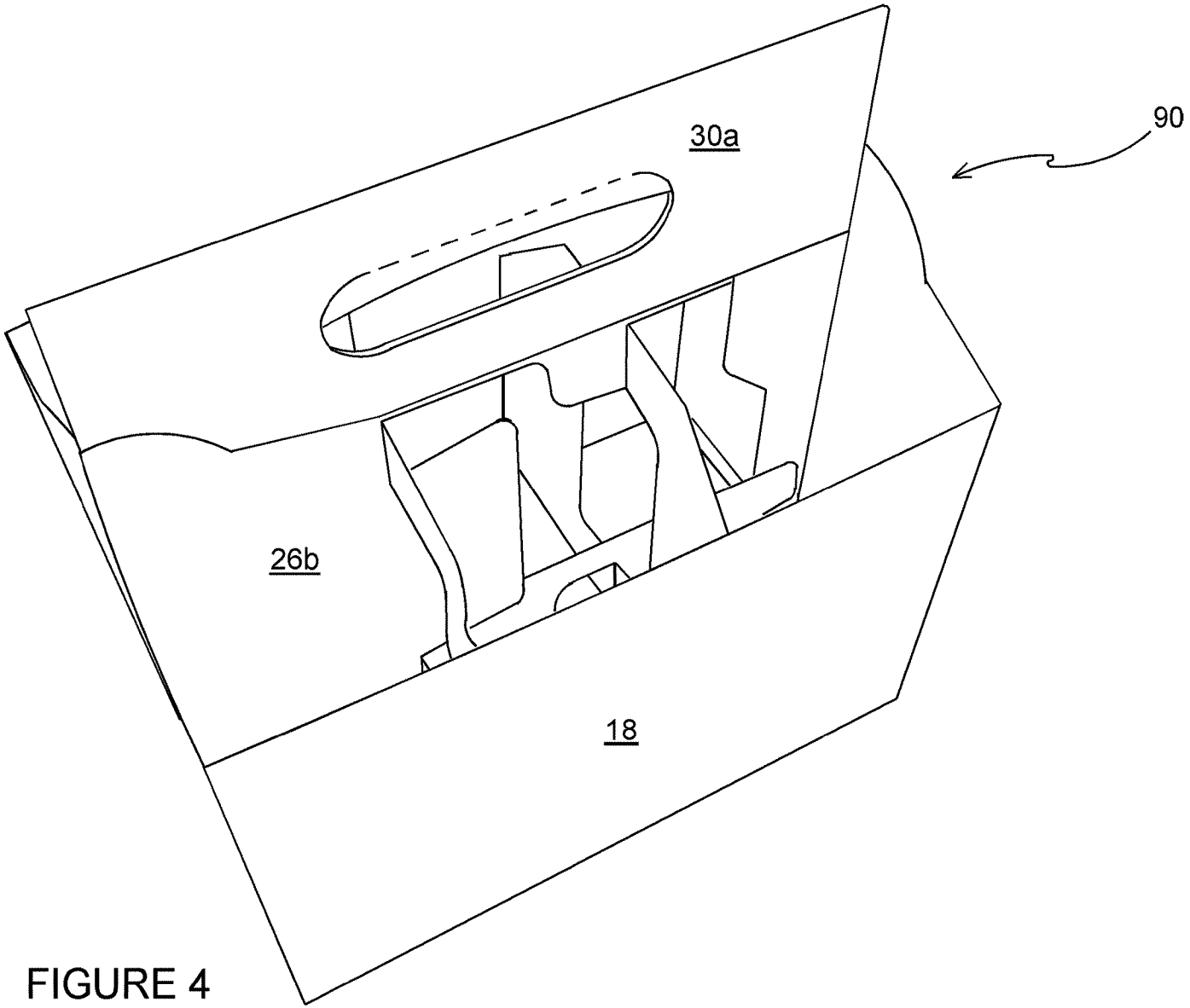
FIG. 4 is a perspective view from above of a carrier formed from the blank of FIG. 1.
Figure 5:
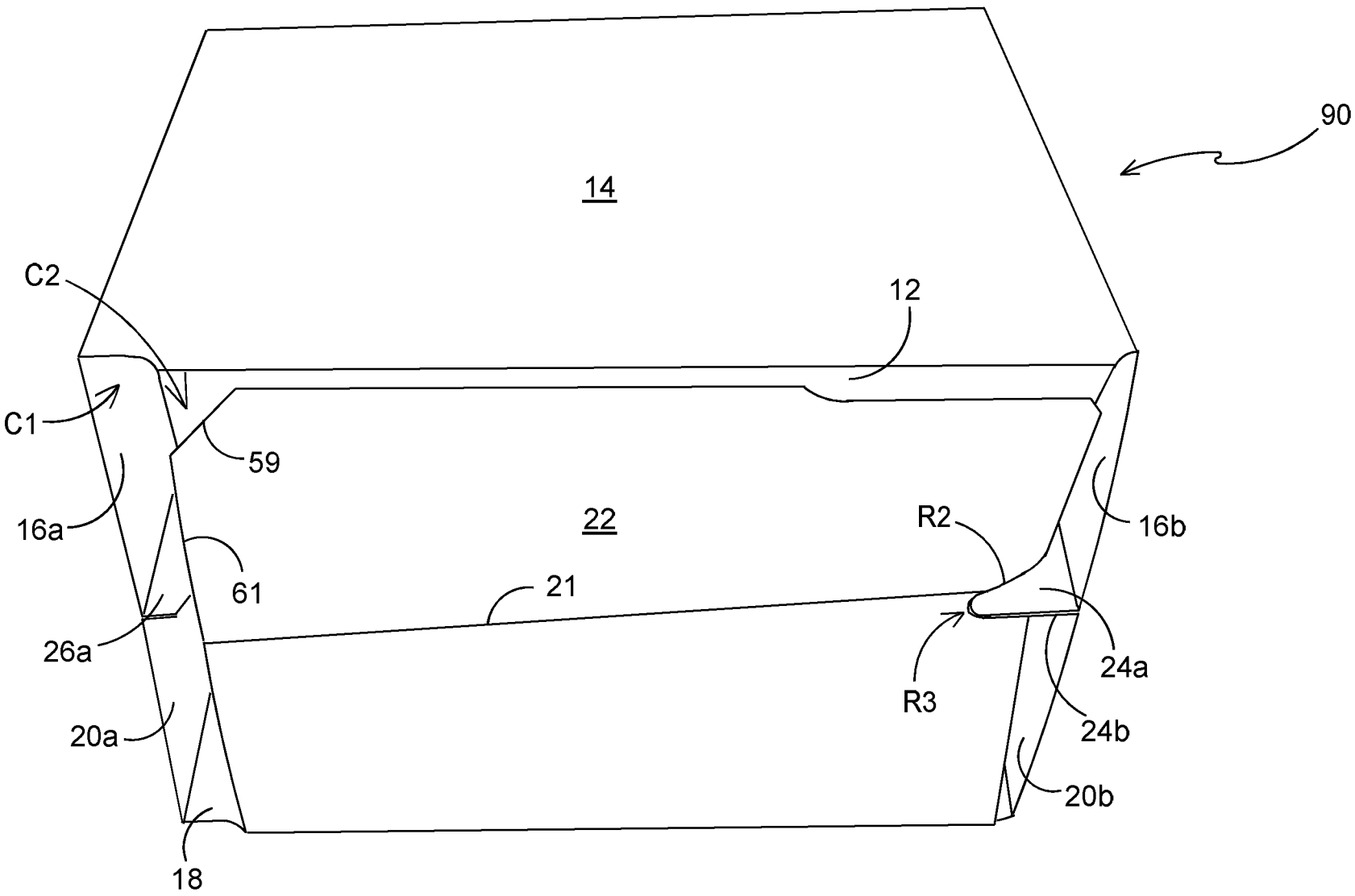
FIG. 5 is a perspective view from above of a carrier formed from the blank of FIG. 1.
Figure 6:
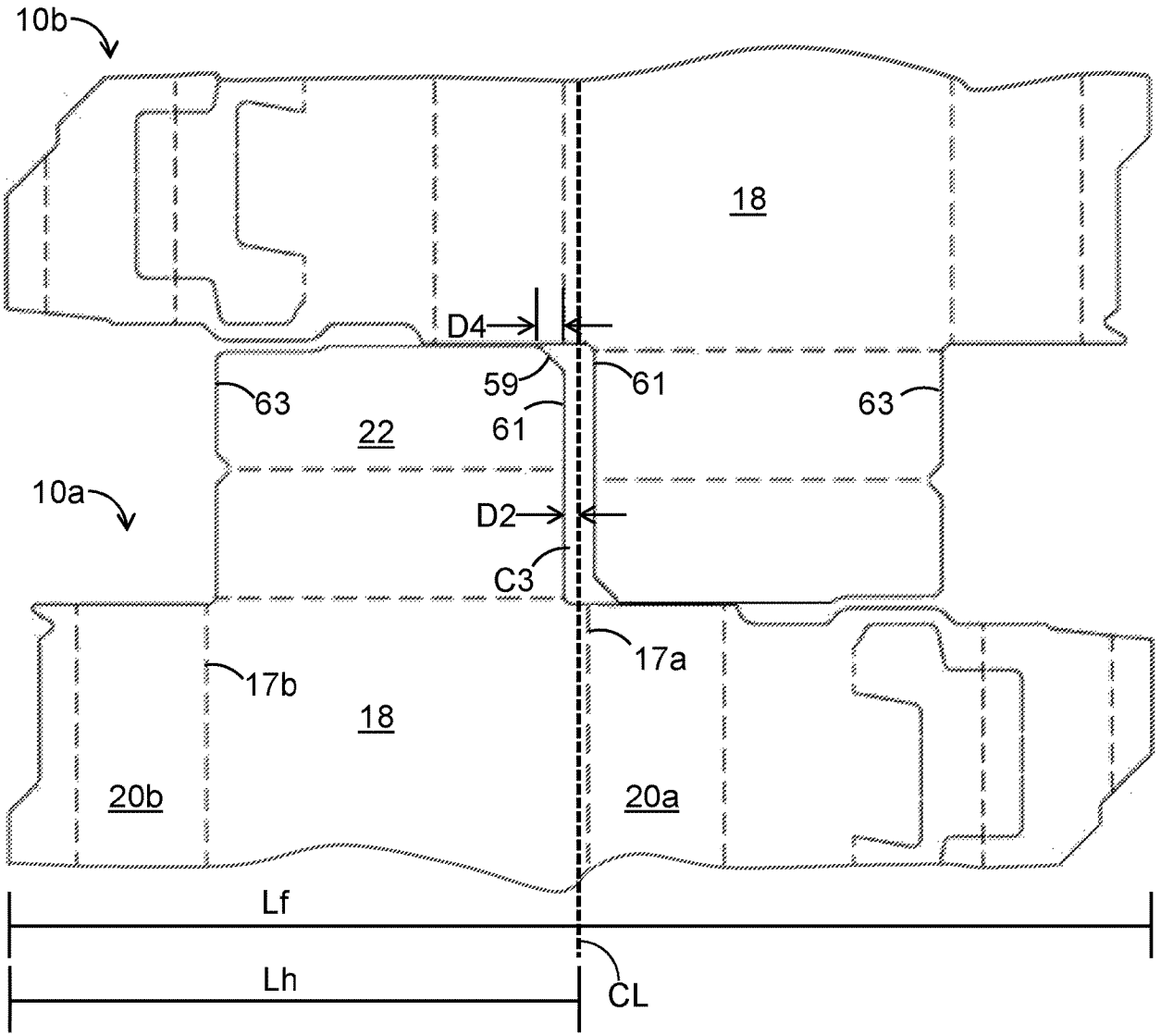
FIG. 6 is an enlarged partial view of a section of the sheet shown in FIG. 3 of material from which a nested group of blanks are arranged.
Figure 8:
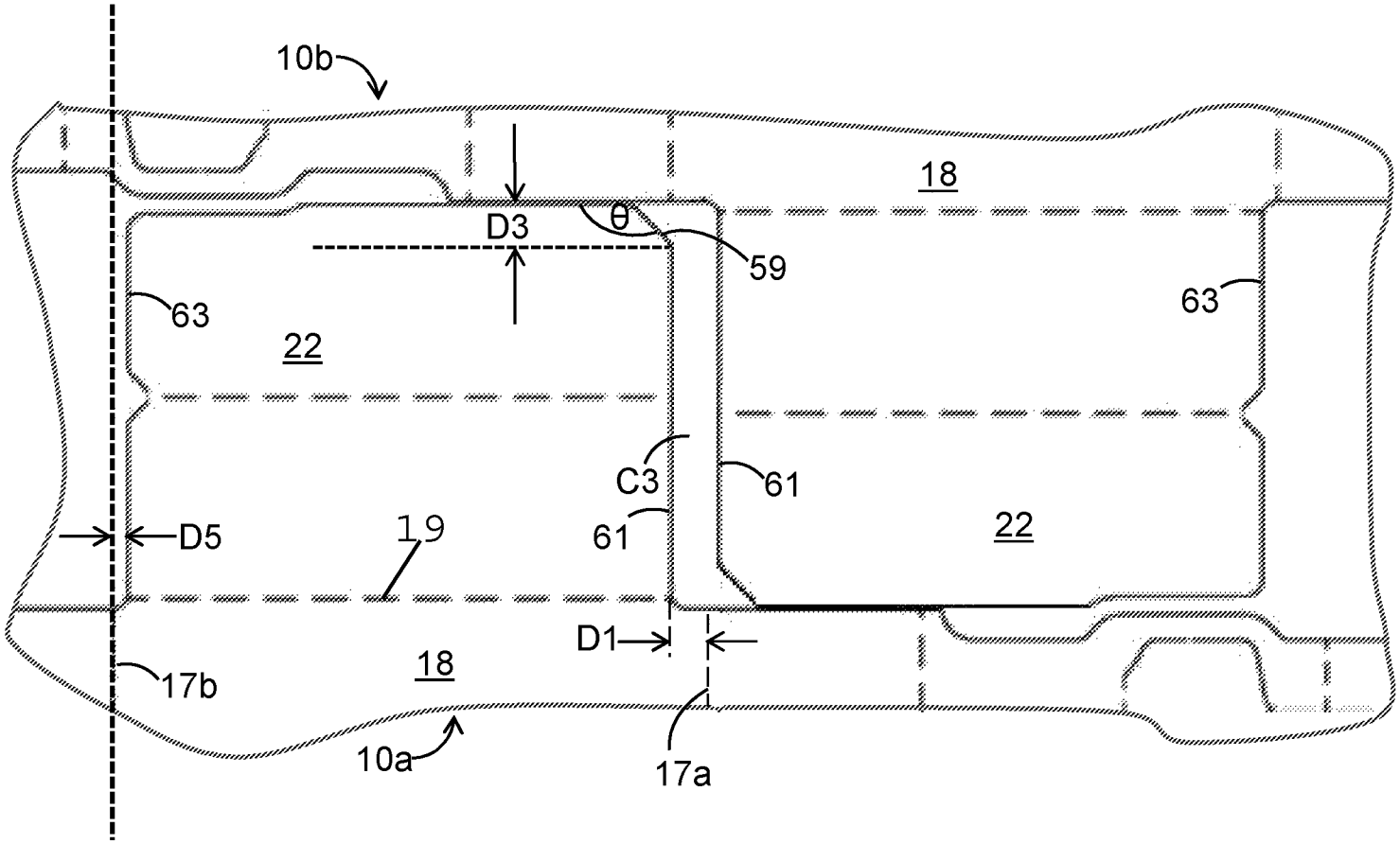
FIG. 8 is a further enlarged partial view of a section of the sheet shown in FIG. 3 of material from which a nested group of blanks are arranged.

Referring to FIGS. 1 and 3-7, and in particular FIGS. 6, 7 and 8 a set of definitions and dimensional relationships, which may be used in the specification and claims, are listed which help to characterize beneficial features of the new blank 10. It will be understood that the definitions are provided in relation to the blank(s) illustrated and that the definitions are accurate for the illustrated blank and that for blanks of other materials and sizes (for holding different number and/or capacity article) similar definitions may hold true within a range of acceptable manufacturing tolerance.

| Dimension | Definition in words |
|---|---|
| Blank Full Length 'Lf' | The maximum end-to-end length of the blank 10. In this arrangement, the maximum end-to-end length of the blank 10 is between a left-hand edge of riser panel 24a and a right-hand edge of second securing panel 41b. (See Figures 1 and 6) |
| Blank Half Length 'Lh' | Half of the maximum end-to-end length of the blank 10. In this arrangement, that is half of the maximum length of blank 10 between the left-hand edge of riser panel 24a and the right-hand edge of second securing panel 41b. (See Figures 1 and 6) |

In mathematical terms: $Lh = \frac{Lf}{2}$

-continued

| Dimension | Definition in words |
|---|---|
| Center Line 'CL' | The center line 'CL' is a notional line through the center of blank 10, positioned at half of the blank's full length. (See Figures 6 and 7) |
| 'C1' | The additional cut-out region on each blank 10 (See Figure 1). |
| 'C3' | The sum of the cut out region C3' (see Figure 2) and the additional cut-out regions C1 on each of two adjacent and nested blanks (see Figure 3). |
| First Center Distance 'D2' | The distance between a first end edge (61) of the bottom panel (22) and the center line 'CL'. (See Figures 6 and 7) |
| First Distance 'D1' | The distance between the first end edge (61) of the bottom panel (22) and a first end edge (17a) of the adjacent first side panel (18). (See Figure 8) |
| Second Distance 'D5' | The distance between a second side edge (17b) of the first side panel (18) and the second end edge (63) of the bottom panel (22). (See Figure 8) |
| Corner Distance 'D4' | The distance between the first end edge (61) of the bottom panel (22) and a notional line (NL) in line with the termination of the beveled corner (59) of the bottom panel (22) along free side edge ('E'). (See Figures 6 and 7) |
| Corner Depth 'D3' | The distance between free side edge ('E') of the bottom panel (22) and a notional line passing through the termination of the beveled corner (59) of the bottom panel (22) along first end edge (61). (See Figure 8) In mathematical terms: $D3 = D4 \cdot \tan(180 - \theta)$ |

Turning to the construction of the carrier 90 from the blank 10 the carrier 90 may be formed by a series of sequential folding operations in a straight-line machine so that the carrier 90 may not be required to be inverted to complete its construction. Construction of the blank 10 into a carrier 90 is conducted in a usual manner and will therefore only be described briefly.

Glue or other adhesive treatment is applied to the first partition panel 26*a* in the region of the third handle structure A4. Similarly, glue or other adhesive treatment is applied to the second partition panel 26*b* in the region of fourth handle structure A3. The first and second handle panels 30*a*, 30*b* are folded 180° about fold lines 29*b*, 29*a* respectively and into face-contacting and affixed relationship with the first partition panel 26*a* and second partition panel 26*b*.

Glue G or other adhesive treatment is applied to the first securing tab 42*a*, second securing tab 41*b*, third securing tab 52*a*, and fourth securing tab 51*b*. The blank 10 is then folded about the fold lines 25*a*, 25*b* so as to bring the first and second securing tabs 42*a*, 41*b* into face contacting relationship with the second side panel 14 and secured thereto. The second and third securing tabs 52*a*, 51*b* are brought into face contacting relationship with the first side panel 18 and are secured thereto.

The blank 10 is folded about fold lines 23*a*, 23*b*, such that portions of the first and second riser panels 24*a*, 24*b* are brought into face contacting relationship with the second and fourth end panels 16*b*, 20*b*.

Glue or other adhesive treatment is then applied to the second riser panel 24*b* and to the second partition panel 26*b*.

Second securing panel 43*a* may then be folded about fold line 43*b* and glue or other adhesive treatment applied to second securing panel 43*a*.

The blank 10 is then folded about fold lines 31*a*, 33 and 31 to bring the first partition panel 26*a* into face contacting relationship with the second partition panel 26 and secured thereto. The first riser panel 24*a* is brought into face contacting relationship with the second riser panel 24*b* and is secured thereto.

Glue or other adhesive treatment is then applied to bottom panel 22, in alternative embodiments glue may be applied to the securing panel 12 (see FIG. 7).

To complete the construction of the blank 10, the bottom panel 22 is folded about fold line 21, such that the securing panel 12 is secured to the bottom panel 22. A flat collapsed carrier is thereby formed; the flat collapsed carrier can be opened into a basket-style article carrier 90, as shown in FIGS. 4 and 5. When the flat collapsed carrier is opened into a basket-style carrier 90 by separating the first and first side panels 14, 18, the partition structures are automatically erected.

Once the carrier 90 is erected, the first and second handle panels 30*a*, 30*b*, first and second partition panels 26*a*, 26*b*, and first and second riser panels 24A, 24B form a medial partition structure that is disposed medially and substantially within the interior of the carrier 90 defined by the outer wall panels 18, 20*b*, 16*b*, 14, 16*a*, 20*a*. The medial partition divides the interior of the carrier 90 into two separate cells. The partition panels 40*a*, 40*b* 50*a*, 50*b* further divide the basket carrier into cells.

As can be seen best in FIG. 5, the asymmetric bottom panel 22 is spaced further from the second end wall 16*a*, 20*a* than it is from the first end wall 16*b*, 20*b*. The similar asymmetric shape and size of the securing panel 12 enables a secure connection between the securing panel 12 and bottom panel 22. Despite the beveled corner 59 and reduced width of the bottom panel 22 (because of the addition cut-out region 'C1'), a sufficiently secure connection between the bottom panel 22 and securing panel 12 is ensured because a glue area G1 in that corner region (see FIG. 7) is sufficiently large enough. Should dimension 'D4' and/or dimension 'D3' be too small and/or dimension 'D2' too large, the security of the bond between the securing panel 12 and bottom panel 22 in that corner region may be compromised and accordingly, it is preferred if the corner distance ('D4') is greater than or equal to the first center distance ('D2') and that the corner distance ('D4') is less than or equal to three times the first center distance ($D2 \leq D4 \leq 3 \times D2$). For similar reasons, additionally or alternatively, it is preferred if a corner depth ('D3') of the beveled corner (59) which is defined by the formula: $D3 = D4 \times \tan(180 - \theta)$, is controlled by the angle 'θ' (the angle defined by the free side edge 'E' and the beveled corner 59 is greater than or equal about 100° and is less than about 145°.

It can be appreciated that various changes may be made within the scope of the present invention. For example, the size and shape of the panels and apertures may be adjusted to accommodate articles of differing size or shape. The carrier may be configured and arranged to package a different number of articles. In such embodiments, the carrier may comprise an alternative number of partition structures so as to separate adjacent articles. In the first illustrated embodiment, the side and end walls 20, 22, 16/18, 24/26 are substantially of the same height as the bottles contained within the carrier. In other embodiments, a top cover may additionally be applied to the carrier to more fully enclose the tops of the articles, albeit utilising the recess for accessing the carrying handle. In yet other embodiments, the side and end walls 20, 22, 16/18, 24/26 are not substantially of the same height as the bottles contained within the carrier.

It will be recognised that as used herein, directional references such as "top", "bottom", "base", "front", "back", "end", "side", "inner", "outer", "upper" and "lower" do not necessarily limit the respective panels to such orientation but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the followings: a scored line, an embossed line, a debossed line, a line of perforations, a line of short slits, a line of half-cuts, a single half-cut, an interrupted cut line, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A blank for forming an article carrier, the blank comprising:

a plurality of panels for forming walls of the carrier including a first side panel, a second side panel, and a bottom panel, the first side panel being adjacently hinged to the bottom panel by a first hinged connection having a length and the bottom panel being asymmetrical and having first and second opposed end edges, the first end edge being offset from a first end edge of the first side panel by a first distance at a portion of the first end edge that joins the first side panel, the second end edge of the bottom panel being offset from a second end edge of the first side panel by a second distance, and the first distance being greater than the second distance, the bottom panel comprising a beveled corner, the beveled corner being located at an intersection of the first end edge of the bottom panel with a free side edge of the bottom panel, the free side edge being opposite from a side edge of the bottom panel that is hinged to the first side panel, wherein the first side panel has a width defined as the distance between first and second end edges thereof, and the length of the first hinged connection is less than the width of the first side panel.

2. The blank according to claim 1 wherein the bottom panel is asymmetrical about a center axis of the first side panel, the center axis being perpendicular to the side edge of the bottom panel hinged to the first side panel.

3. The blank according to claim 1, wherein the bottom panel has a width defined as the distance between first and second opposed end edges thereof, wherein the width of the bottom panel is less than the width of the first side panel, and wherein a notional half-way line of the bottom panel is off-set from a notional half-way line of the first side panel.

4. The blank according to claim 1, wherein the second side panel is spaced from and located opposite to the first side panel, and wherein a securing panel is hinged to the second side panel by a second hinged connection having a length, the securing panel is configured for attachment to the bottom panel, and the securing panel is asymmetrical about a center axis of the adjacent second side panel and has first and second opposed end edges, wherein the first end edge of the securing panel is offset from a first end edge of the adjacent second side panel by a third distance, wherein the second end edge of the securing panel is offset from a second end edge of the adjacent second side panel by a fourth distance, wherein the third distance is greater than the fourth distance, and wherein the length of the second hinged connection is less than the width of the first side panel.

5. The blank according to claim 4 wherein the third distance is a similar distance to the first distance at which the first end edge of the bottom panel (22) is offset from the first end edge of the first side panel.

6. The blank according to claim 1 cut from a larger sheet of material along with a plurality of other similar such blanks and wherein said other similar such blanks and said blank are closely nested on said larger sheet of material.

7. The blank according to claim 1, wherein the second end edge of the bottom panel is offset from the second end edge of the first side panel at a portion of the second end edge of the bottom panel that joins the first side panel.

8. A blank for forming an article carrier, the blank comprising:

a plurality of panels for forming walls of the carrier including a first side panel, a second side panel and a bottom panel, the first side panel being hinged to the bottom panel by a first hinged connection having a length and the bottom panel being asymmetrical and having first and second opposed end edges, the first end edge of the bottom panel being offset from a first end edge of the adjacent first side panel by a first distance, the second end edge of the bottom panel being offset from a second end edge of the adjacent first side panel by a second distance, and the first distance being greater than the second distance, the bottom panel comprising a beveled corner, the beveled corner being located at an intersection of the first end edge of the bottom panel with a free side edge of the bottom panel, the free side edge being opposite from a side edge of the bottom panel that is hinged to the first side panel, wherein a center line is defined by a notional line through a center of the blank, positioned half-way along the length of the blank, wherein a corner distance is defined as the distance between a notional line coincident with the first end edge of the bottom panel and a notional line that is coincident with a termination of the beveled corner along said free side edge and that is parallel to the notional line coincident with the first end edge of the bottom panel, wherein a first center distance is defined as the distance between the first end edge of the bottom panel and the center line, and wherein the corner distance is greater than or equal to the first center distance.

9. The blank according to claim 8 wherein the first distance is greater than the first center distance and wherein the first distance is less than two times the first center distance.

10. The blank according to claim 8 wherein a corner depth of the beveled corner is defined by the formula: $D3=D4\times\tan(180-\theta)$, wherein 'D3' is the corner depth, 'D4' is the corner distance, and 'θ' is an angle defined by the free side edge and the beveled corner interior to the blank.

11. The blank according to claim 10, wherein said angle 'θ' is greater than or equal to about 100° and is less than about 145°.

12. The blank of claim 8 wherein the corner distance is less than or equal to three times the first center distance.

13. An article carrier formed from a blank, the article carrier comprising:

a plurality of outer walls comprising first and second side panels and a bottom panel;

wherein the bottom panel is adjacently hinged to the first side panel by a first hinged connection having a length, the bottom panel being asymmetrical and having first and second opposed end edges, wherein the first end edge is offset from a first end edge of the first side panel by a first distance, wherein the second end edge of the bottom panel is offset from a second end edge of the first side panel by a second distance, and wherein the first distance is greater than the second distance; and the bottom panel comprising a beveled corner, which beveled corner is located at an intersection of the first end edge of the bottom panel with a free side edge of the bottom panel, which free side edge is opposite from a side edge of the bottom panel that is hinged to the first side panel, wherein the first side panel has a width defined as the distance between first and second end edges thereof, and the length of the first hinged connection is less than the width of the first side panel.

14. The article carrier according to claim 13, comprising: a medial partition structure formed from at least two medial panels hingedly connected to each other, the medial partition structure being coupled to at least one of the plurality of outer walls.

15. The article carrier according to claim 14 wherein a carrying handle is formed in the medial partition structure.

16. The article carrier according to claim 13, wherein the first end edge of the bottom panel is offset from the first end edge of the first side panel at a portion of the first end edge of the bottom panel that joins the first side panel.

17. The article carrier according to claim 16, wherein the second end edge of the bottom panel is offset from the second end edge of the first side panel at a portion of the second end edge of the bottom panel that joins the first side panel.

* * * * *